US009990909B1

(12) United States Patent
Azaceta

(10) Patent No.: US 9,990,909 B1
(45) Date of Patent: Jun. 5, 2018

(54) CYMBAL

(71) Applicant: RTOM Corporation, Carlstadt, NJ (US)

(72) Inventor: Gabriel Azaceta, Bloomfield, NJ (US)

(73) Assignee: RTOM CORPORATION, Carlstadt, NJ (US)

( * ) Notice: Subject to any disclaimer, the term of this patent is extended or adjusted under 35 U.S.C. 154(b) by 0 days. days.

(21) Appl. No.: 15/647,323

(22) Filed: Jul. 12, 2017

(51) Int. Cl.
*G10D 13/06* (2006.01)
*G10D 13/02* (2006.01)
*G10K 11/00* (2006.01)

(52) U.S. Cl.
CPC ..... *G10D 13/06* (2013.01); *G10D 13/029* (2013.01); *G10K 11/002* (2013.01)

(58) Field of Classification Search
CPC ..... G10D 13/06; G10D 13/029; G10K 11/002
USPC ..... 84/422.1
See application file for complete search history.

(56) References Cited

U.S. PATENT DOCUMENTS 641,028 A * 1/1900 Meehan ..... F24F 7/02 138/89
D301,893 S * 6/1989 Hargrove ..... 84/402
D526,001 S * 8/2006 Scharte ..... D17/22
D532,439 S * 11/2006 Scharte ..... D17/22
7,199,297 B2 * 4/2007 Anderson ..... G10D 13/06 84/422.3
7,488,887 B2 * 2/2009 Mori ..... G10D 13/024 84/723
7,498,500 B2 * 3/2009 Rogers ..... G10D 13/029 84/411 M
D597,589 S * 8/2009 Onishi ..... D17/22
D607,921 S * 1/2010 Onishi ..... D17/22
7,750,218 B2 * 7/2010 Stannard ..... G10D 13/06 84/402
7,943,841 B2 * 5/2011 Toda ..... G10H 1/348 84/104
7,948,500 B2 5/2011 Newhall, Jr.
7,952,009 B2 * 5/2011 Stannard ..... G10D 13/06 84/402
RE43,885 E * 1/2013 Rogers ..... G10D 13/029 84/411 A
8,497,418 B2 * 7/2013 Roderick ..... G10H 3/143 84/464 A
D688,737 S * 8/2013 Tatsumi ..... D17/22
D692,943 S * 11/2013 Tatsumi ..... D17/22
8,729,378 B2 5/2014 Ryan et al.
8,841,527 B2 * 9/2014 Shih ..... G10H 1/32 84/104
8,865,986 B1 * 10/2014 Twyford ..... G10D 13/06 84/402
8,940,994 B2 1/2015 Truchsess
9,053,693 B1 * 6/2015 Wei ..... G10H 3/00
D788,742 S * 6/2017 Vellozo Luz ..... D14/217
2002/0059861 A1 * 5/2002 Yoshino ..... G10D 13/024 84/402

(Continued)

FOREIGN PATENT DOCUMENTS

JP 11184459 A 7/1997
JP 11184459 A * 7/1999 ..... G10D 13/029
JP 2010072510 A * 4/2010

*Primary Examiner* — David Warren
*Assistant Examiner* — Christina Schreiber
(74) *Attorney, Agent, or Firm* — Florek & Endres PLLC

(57) ABSTRACT

A cymbal having a plurality of openings where at least a portion of the material removed from the plurality of openings is maintained on the cymbal.

20 Claims, 4 Drawing Sheets

(56) References Cited

U.S. PATENT DOCUMENTS

| | | | | |
|---|---|---|---|---|
| 2005/0145101 | A1* | 7/2005 | Yoshino | G10H 1/32 84/723 |
| 2005/0145102 | A1* | 7/2005 | Susami | G10H 3/146 84/735 |
| 2005/0155483 | A1* | 7/2005 | Anderson | G10D 13/06 84/422.3 |
| 2006/0156910 | A1* | 7/2006 | Yoshino | G10H 1/34 84/723 |
| 2007/0131090 | A1* | 6/2007 | Stannard | G10D 13/06 84/422.4 |
| 2008/0105104 | A1* | 5/2008 | Stannard | G10D 13/06 84/402 |
| 2012/0060670 | A1* | 3/2012 | Truchsess | G10D 13/06 84/724 |
| 2012/0144980 | A1* | 6/2012 | Roderick | G10H 3/143 84/723 |
| 2013/0312590 | A1* | 11/2013 | Truchsess | G10H 3/146 84/725 |
| 2014/0083276 | A1* | 3/2014 | Yoshino | G10D 13/06 84/422.1 |
| 2015/0269921 | A1* | 9/2015 | Truchsess | G10D 13/06 84/422.1 |
| 2016/0196811 | A1* | 7/2016 | Shen | G10H 1/32 84/422.1 |
| 2016/0203804 | A1* | 7/2016 | Carpenter, Sr. | G10D 13/06 84/422.3 |
| 2016/0247492 | A1* | 8/2016 | Field | G10D 13/024 |

* cited by examiner

CYMBAL

FIELD OF THE INVENTION

The present invention relates to a musical cymbal, and more particularly to a musical cymbal with openings that produce a lower volume than a solid cymbal of the same dimensions.

BACKGROUND OF THE INVENTION

Unless a player has a dedicated space with noise containment, one of the difficulties in practicing drums with cymbals is the volume of the instruments when played. Unlike a guitar, bass, electronic keyboard or the like, where the player can modulate volume, it is difficult to modulate the volume of drums and cymbals while retaining a realistic feel.

One advance in lowering the volume to practice drums is found in the BLACK HOLE system from RTOM Corporation, as described in U.S. Pat. Nos. 7,498,500 and RE43,885, which utilizes tensioned mesh drumheads installed over acoustic drums or drumheads. This allows the user to experience the feel of a tensioned drumhead and achieve a sound quality and tone similar to that of the acoustic drum over which the tensioned mesh drumhead is mounted, but at a lower volume. This result is achieved by the reduced air moved by the mesh drumhead that creates a sympathetic response from the acoustic drumhead, but without the volume generated if the acoustic drumhead were struck directly.

This effect, however, cannot be replicated in cymbals while maintaining the feel of striking a cymbal due to the metal composition of a cymbal.

Nonetheless, other efforts have been made to create a cymbal that can be played at reduced volumes. These include Japanese Patent Application Nos. 2010072510 and 11184459, which describe the use of placing holes in the cymbals. With respect to the use of perforations in cymbals, U.S. Pat. Nos. D597589 and D607921 show specific patterns of holes for use in electronic cymbals.

However, the prior art has not been able to come up with a low volume cymbal that has the a similar feel and sound as achieved when striking a traditional cymbal.

SUMMARY OF THE INVENTION

The present invention is directed to a cymbal comprising a plurality of openings where at least a portion of the material removed from the plurality of openings is maintained on the cymbal. Maintaining the material removed from the openings provides a cymbal with a reduced surface area but with the same mass, or only a limited reduction in mass, of a solid cymbal of the same material and dimensions. This imparts the low volume cymbal of the present invention with the feel of a solid cymbal with the same dimensions when struck.

In a preferred embodiment, the plurality of openings is formed by cutting a U-shaped form in cymbal and deflecting the material in the U-shaped area downwardly below an upper surface of the cymbal. Of course, the cutout can be any shape, including V-shaped, semi-circular, squared at the bottom, etc., and varying combinations of differing shapes, without deviating from the invention. Moreover, the cymbal can have additional openings that do not retain the material from the openings without deviating from the invention.

Since the cymbals are to be played with standard drumsticks, the size of the openings are preferably about one-half the size of the tip of a standard drumstick, so that the drummer does not feel the drumstick hitting the opening. However, the size of the openings can be larger depending on the amount of material to be removed. Moreover, different areas of the cymbal can have different sized openings, or no openings at all. For example, openings at the bell of the cymbal, where the drummer does not generally strike the cymbal, may have larger openings than those on the bow. In another embodiment, the openings may be only on the bow without any openings on the bell of the cymbal.

In a preferred embodiment, the openings reduce the surface area of the low volume cymbal of the present invention by from about 2% to about 50% of the top surface of the cymbal, with a reduction in surface area of the cymbal by about 5% to about 25% being most preferred. However, as mentioned above, the overall mass of the cymbal of the present invention is preferably from about 60% to about 100%, and most preferably from about 90% to about 100%, of the mass of a solid cymbal of corresponding dimensions.

The openings can be formed in any pattern desired, however, openings formed radiating from the center hole outward is suitable for the purposes of the invention. Additionally, the radiating pattern may be offset between adjacent lines of openings to permit more openings as the radiating lines move closer to the center of the cymbal.

BRIEF DESCRIPTION OF THE DRAWINGS

The attached drawings are intended to better illustrate a preferred embodiment of the present invention without limiting the invention in any manner whatsoever.

DETAILED DESCRIPTION OF THE PREFERRED EMBODIMENT

The following description of the preferred embodiment is presented to describe the present invention without limiting the scope of the appended claims in any manner whatsoever.

As shown in FIGS. 1-4, the present invention is directed to a cymbal 2 with a plurality of openings 4 where at least a portion of the material removed from the plurality of openings 4 is maintained on the cymbal 2.

Figure 1:
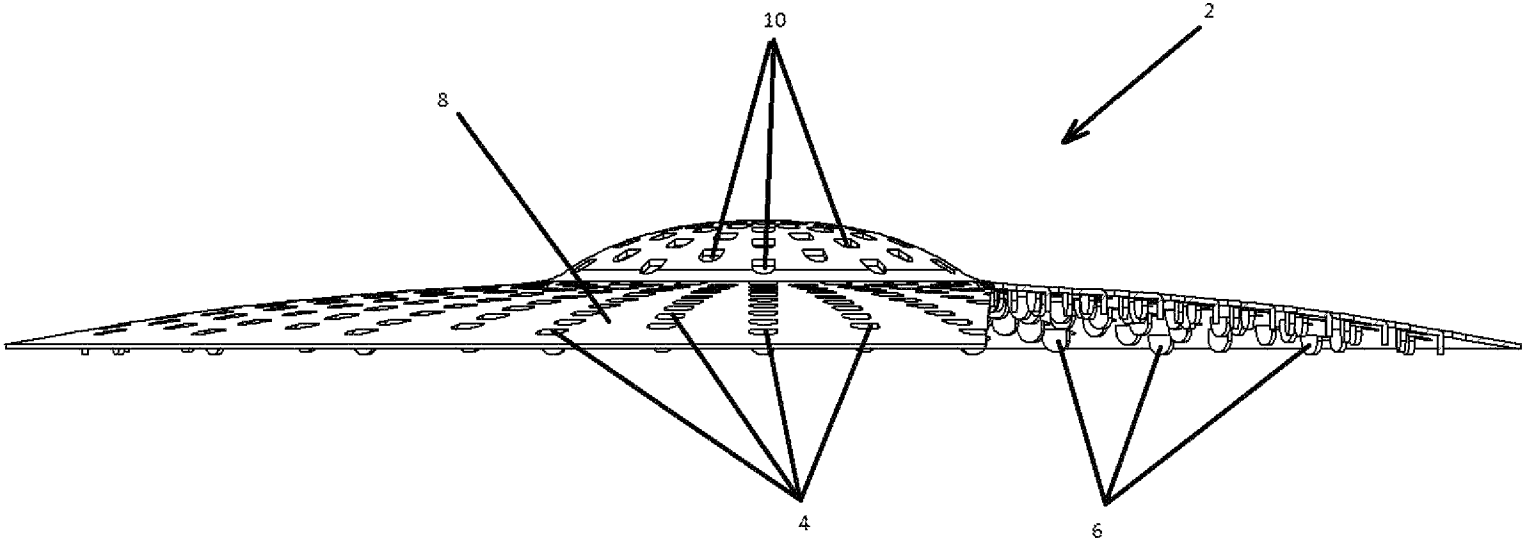
FIG. 1 is a side elevation of an embodiment of the cymbal of the present invention in partial cross section.
Figure 2:
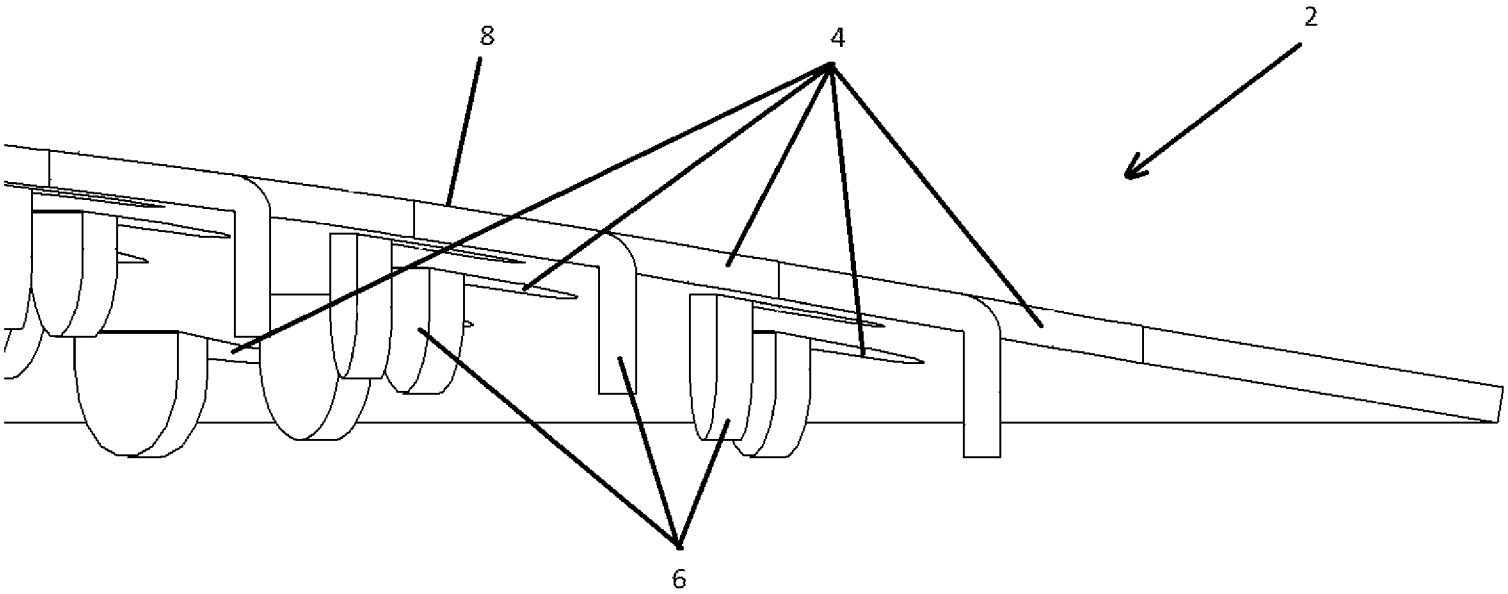
FIG. 2 is a partial cross section close up of the cymbal of the present invention.
Figure 4:
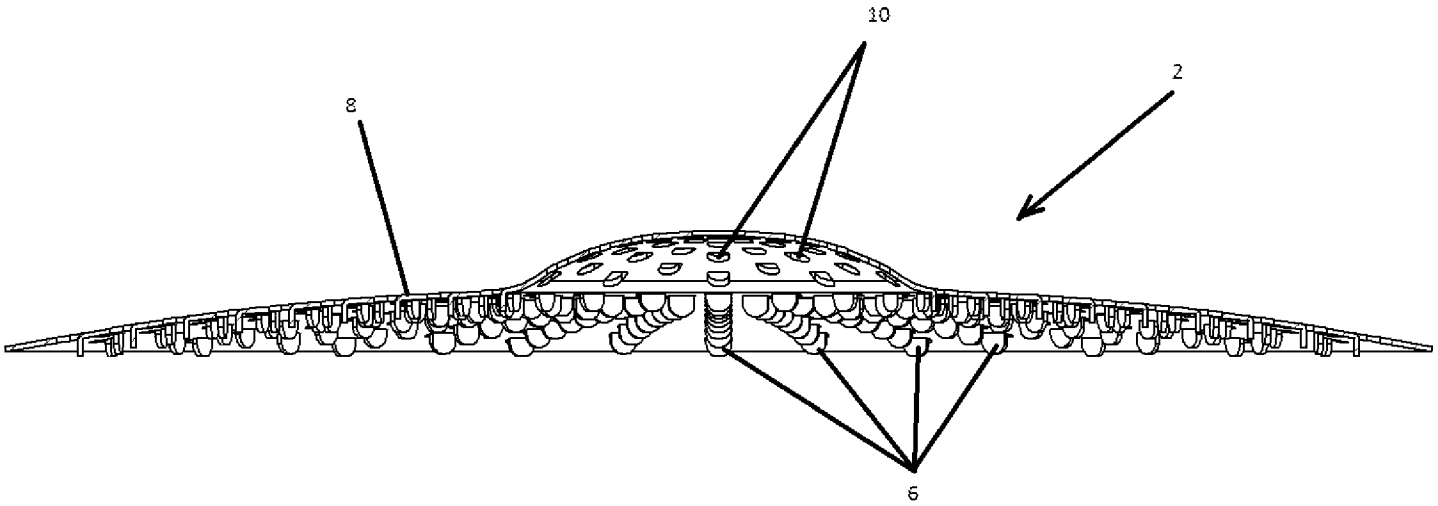
FIG. 4 is a cross section of an embodiment of the cymbal of the present invention.

As best seen in FIGS. 1, 2 and 4, the preferred embodiment maintains at least a portion of the material removed from the openings as tabs 6 extending downwardly from the top surface 8 of the cymbal 2. More particularly, as best shown in FIG. 2, the openings 4 are preferably formed by cutting the cymbal 2 along a portion of the perimeter of the opening 4 and deflecting or bending the material within the opening 4 downwardly below the top surface 8 of the cymbal 2 along the attached portion of the opening 4.

Notwithstanding the preferred embodiment shown and described, it is understood that the material from the openings 4 can be maintained on the cymbal 2 by moving the material to another area on the cymbal 2, preferably in the area near or around the openings 4 by thickening the material in these areas.

The shape of the openings 4 is preferably U-shaped, as shown in the attached drawings, however, it is understood that any suitable shape can be used for the openings 4. Moreover, the openings 4 can be other shapes or combinations of different shapes, and can be used exclusively on the cymbal 2 or in combination with secondary openings 10 that do not retain the material of the secondary openings 10 on the cymbal 2.

For example, as shown in FIG. 4, the openings 4 on the bow of the cymbal 2 are formed by deflecting the material of the openings 4 below the top surface 8 on the bow of the cymbal, but the bell of the cymbal 2 has secondary openings 10 with the material of the secondary openings 10 removed.

Of course, some of the material of the openings 4 may be lost by virtue of the cutting of the openings 4 about the perimeter on the non-attached portions. However, it is expected that the majority of the material of the opening 4 is maintained on the cymbal 2 for the plurality of openings 2. Therefore, the overall mass of the cymbal 2 of the present invention is maintained at from about 60% to about 100% of the mass of a solid cymbal of corresponding dimensions, and preferably from about 90% to about 100% of the mass of a solid cymbal of corresponding dimensions. When the cymbal 2 includes secondary openings 10, it is understood that the mass of the cymbal 2 would be less than 100%, and preferably up to about 99% rather than 100%.

The cymbal 2 of the present invention is adapted to have a top surface 8 with a surface area reduced by from about 2% to about 50% of the top surface 8 of the cymbal 2 due to the openings 4 and secondary openings 10. In the preferred embodiment, a reduction in surface area of the top surface 8 of the cymbal 2 by about 5% to about 25% has been found to be suitable to create a sufficiently lower volume than a solid cymbal with the same dimensions. As will be understood, the greater the reduction of the surface area of the cymbal 2, the greater the reduction in volume from the volume generated by a solid cymbal of the same dimensions.

Figure 3:
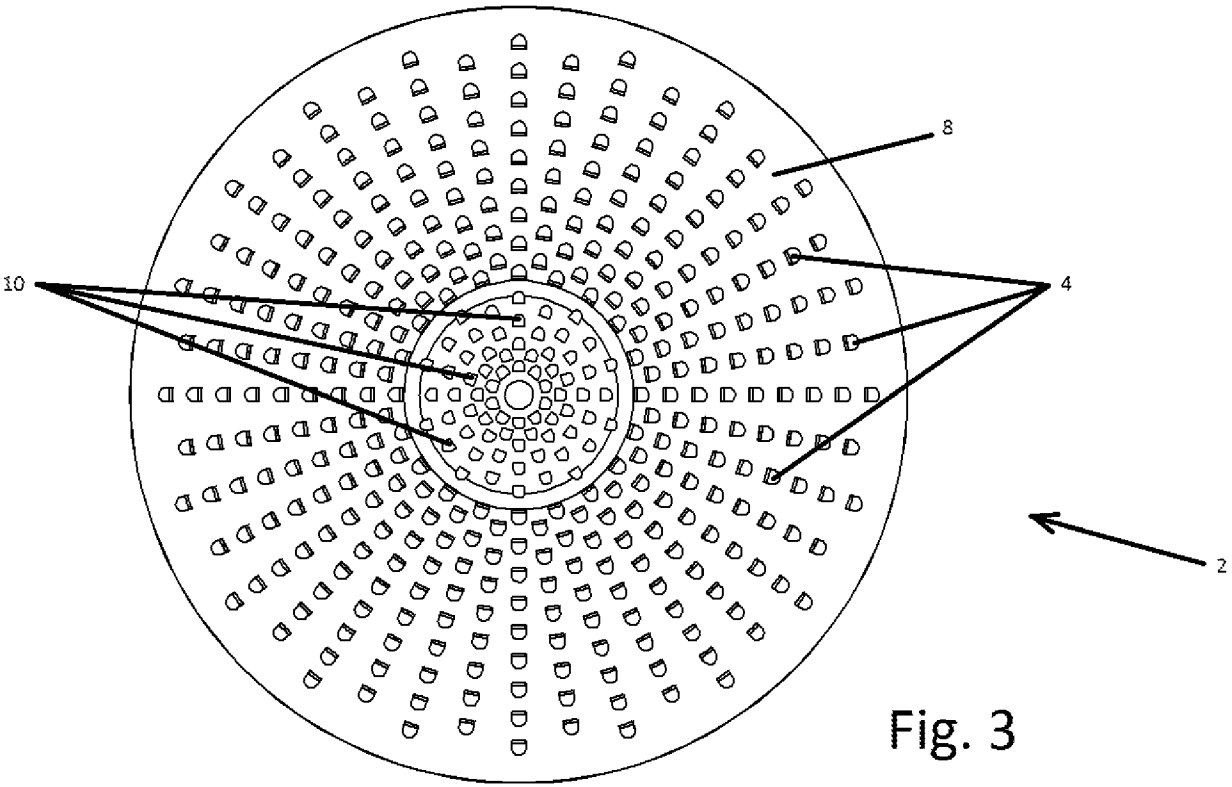
FIG. 3 is a plan view of an embodiment of the cymbal of the present invention.

The openings 4 can be formed in any pattern desired, however, openings 4 formed radiating from the center of the cymbal 2 outwardly, as shown in FIG. 3, has been found to be suitable for the purposes of the invention. It is also preferred that when using a radiating pattern of openings 4, the adjacent radiating lines of openings 4 are offset to permit more openings 4 as the radiating lines move closer to the center of the cymbal 2.

Variations, modifications and alterations to the preferred embodiment of the present invention described above will make themselves apparent to those skilled in the art. All such variations, modifications, alterations and the like are intended to fall within the spirit and scope of the present invention, limited solely by the appended claims. Additionally, all prior art referred to herein is hereby incorporated by reference.

The invention claimed is:

1. A cymbal formed of a cymbal material, said cymbal comprising a substantially flat upper surface and a plurality of openings formed by displacement of at least a portion of the cymbal material from the openings, where at least a portion of the cymbal material displaced to form the plurality of openings is maintained on the cymbal, and where no portion of the cymbal material displaced from the openings and maintained on the cymbal extends above the substantially flat upper surface of the cymbal.

2. The cymbal of claim 1 wherein at least a portion of the material displaced from the cymbal to form the plurality of openings is deflected downwardly below the top surface of the cymbal.

3. The cymbal of claim 1 wherein one or more of the plurality of openings are U-shaped.

4. The cymbal of claim 1 further comprising secondary openings formed by removal of cymbal material from the secondary openings.

5. The cymbal of claim 1 comprising a mass wherein the mass of the cymbal is from about 60% to about 100% of a mass of a solid cymbal of corresponding dimensions.

6. The cymbal of claim 1 comprising a mass wherein the mass of the cymbal is from about 90% to about 100% of a mass of a solid cymbal of corresponding dimensions.

7. The cymbal of claim 1 wherein the substantially flat upper surface has a surface area wherein the plurality of openings reduce the surface area of the upper surface by from about 2% to about 50%.

8. The cymbal of claim 1 wherein the substantially flat upper surface has a surface area wherein the plurality of openings reduce the surface area of the upper surface by from about 5% to about 25%.

9. The cymbal of claim 1 wherein the plurality of openings are formed in a pattern of radiating lines radiating outwardly from a center of the cymbal.

10. The cymbal of claim 9 wherein the first openings of adjacent radiating lines are offset.

11. A cymbal formed of a cymbal material, said cymbal comprising a substantially flat upper surface, a plurality of first openings and one or more second openings, where the plurality of first openings are formed by displacement of at least a portion of the cymbal material from the first openings and one or more second openings are formed by removal of the cymbal material from the second openings, where at least a portion of the cymbal material displaced to form the plurality of first openings is maintained on the cymbal, where the cymbal material from the one or more second openings is removed from the cymbal, and where no portion of the cymbal material displaced from the first openings maintained on the cymbal extends above the substantially flat upper surface.

12. The cymbal of claim 11 wherein at least a portion of the cymbal material displaced to form the plurality of first openings is deflected downwardly below a bottom surface of the cymbal.

13. The cymbal of claim 11 wherein one or more of the plurality of first openings are U-shaped.

14. The cymbal of claim 11 comprising a bell and a bow, wherein one or more of the second openings are on the bell.

15. The cymbal of claim 11 comprising a mass wherein the mass of the cymbal is from about 60% to about 99% of a mass of a solid cymbal of corresponding dimensions.

16. The cymbal of claim 11 comprising a mass wherein the mass of the cymbal is from about 90% to about 99% of a mass of a solid cymbal of corresponding dimensions.

17. The cymbal of claim 11 wherein the upper surface has a surface area and further wherein the plurality of first openings and one or more second openings reduce the surface area of the upper surface by from about 2% to about 50%.

18. The cymbal of claim 11 wherein the upper surface has a surface area and further wherein the plurality of first openings and one or more second openings reduce the surface area of the upper surface by from about 5% to about 25%.

19. The cymbal of claim 11 wherein the plurality of first openings are formed in a pattern of radiating lines radiating outwardly from a center of the cymbal.

20. The cymbal of claim 19 wherein the first openings of adjacent radiating lines are offset.

* * * * *